US007877051B2

(12) United States Patent
Ahn

(10) Patent No.: US 7,877,051 B2
(45) Date of Patent: Jan. 25, 2011

(54) FUSING UNIT AND IMAGE FORMING APPARATUS HAVING THE SAME

(75) Inventor: Byeong-hwa Ahn, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 331 days.

(21) Appl. No.: 12/029,705

(22) Filed: Feb. 12, 2008

(65) Prior Publication Data

US 2008/0310894 A1 Dec. 18, 2008

(30) Foreign Application Priority Data

Jun. 15, 2007 (KR) ..... 10-2007-0059115

(51) Int. Cl.
*G03G 15/20* (2006.01)

(52) U.S. Cl. ..... 399/328; 399/330; 399/331

(58) Field of Classification Search ..... 399/328, 399/330, 331, 320, 122, 67; 219/216; 432/60
See application file for complete search history.

(56) References Cited

U.S. PATENT DOCUMENTS 6,975,829 B2 * 12/2005 Aruga ..... 399/329
7,613,411 B2 * 11/2009 Tateishi et al. ..... 399/69
2007/0020003 A1 * 1/2007 Kang et al. ..... 399/328
2007/0025783 A1 * 2/2007 Jang et al. ..... 399/328
2007/0104522 A1 * 5/2007 Kang et al. ..... 399/333

FOREIGN PATENT DOCUMENTS

JP 63-274968 11/1998

* cited by examiner

*Primary Examiner*—David P Porta
*Assistant Examiner*—Faye Boosalis
(74) *Attorney, Agent, or Firm*—Staas & Halsey LLP

(57) ABSTRACT

A fusing unit for an image forming apparatus, including a heating roller to apply heat to a printable medium; a first pressing roller facing the heating roller so as to press the printable medium against the heating roller; a second pressing roller disposed in front of the first pressing roller in a proceeding direction of the printable medium press the printable medium against the heating roller; and a driving unit to transmit a rotation force to the second pressing roller so that a surface linear speed of the second pressing roller is greater than a surface linear speed of the heating roller.

25 Claims, 5 Drawing Sheets

FUSING UNIT AND IMAGE FORMING APPARATUS HAVING THE SAME

CROSS-REFERENCE TO RELATED APPLICATION

This application claims the benefit of Korean Patent Application No. 2007-59115, filed in the Korean Intellectual Property Office on Jun. 15, 2007, the disclosure of which is incorporated herein by reference.

BACKGROUND OF THE INVENTION

1. Field of the Invention

Aspects of the present invention relate to a fusing unit and an image forming apparatus having the same including a plurality of pressing rollers to fuse an image transferred to a printable medium.

2. Description of the Related Art

Generally, an electrophotographic image forming apparatus scans a light onto a photosensitive medium charged to have a predetermined electric potential to form an electrostatic latent image, develops the electrostatic latent image with a predetermined color, and transfers and fuses the developed image onto a printable medium to print an image. A fusing unit is provided along a printing path of the image forming apparatus. The fusing unit fuses a developer image transferred to the printable medium onto the printable medium.

The fusing unit includes a heating roller and a pressing roller with the printable medium interposed therebetween. The heating roller applies heat to the printable medium. The pressing roller applies pressure to the printable medium to fuse the developer onto the printable medium. Fusing units generally employ a plurality of pressing rollers to widen a nip area between the heating roller and the pressing roller where the developer image is fused onto the printable medium to improve fusing efficiency.

FIG. 1 is a schematic view illustrating a configuration of a conventional fusing unit 10 employing a plurality of pressing rollers. The conventional fusing unit 10 includes a heating roller 20 applying heat to the printable medium M, and a first pressing roller 30 and a second pressing roller 40 facing the heating roller 20. The first pressing roller 30 and the second pressing roller 40 rotate passively by means of a friction force generated by the rotation of the heating roller 20. Accordingly, the first pressing roller 30 and the second pressing roller 40 rotate with the same speed as the heating roller 20.

In the conventional fusing unit 10, before the printable medium M passing the first pressing roller 30 enters the nip between the second pressing roller 40 and the heating roller 20, the printable medium M is separated from the heating roller 20 to generate a detached area A. Since the printable medium M is apt to proceed in a tangential direction to the heating roller 20 after passing the first pressing roller 30, the printable medium M does not remain in contact with the heating roller until the leading edge of the printable medium M passes between the second pressing roller 40 and the heating roller 20.

Since a developer image T on the area A of the printable medium M that is separated from the heating roller 20 does not have a sufficient fusing time, the developer image T may separate from the printable medium M. As a result, a spot is generated in an image formed on the printable medium M, and printing quality deteriorates.

The separation of the developer image, and the spot generated by the separation of the developer image, may be aggravated in the case of a color image forming apparatus using a plurality of developer units for color image forming operations.

SUMMARY OF THE INVENTION

Aspects of the present invention provide a fusing unit and an image forming apparatus having the same enabling a printable medium to pass a plurality of pressing rollers forcedly contacting a heating roller, thereby improving fusing efficiency.

According to an aspect a fusing unit for an image forming apparatus, including: a heating roller which applies heat to a printable medium; a first pressing roller which faces the heating roller to press the printable medium; a second pressing roller which is disposed in front of the first pressing roller in a proceeding direction of the printable medium, and presses the printable medium; and a driving unit which transmits rotation force to the second pressing roller so that a surface linear speed of the second pressing roller can be greater than a surface linear speed of the heating roller.

According to another aspect of the present invention, the driving unit includes a gearing unit to transmit a rotation force of the heating roller to the second pressing roller.

According to another aspect of the present invention, the gearing unit includes a heating roller gear provided to a rotation shaft of the heating roller to receive a driving force of the driving unit, and a pressing roller gear provided to a rotation shaft of the second pressing roller to be engaged with the heating roller gear to receive the driving force.

According to another aspect of the present invention, the diameter of the pressing roller gear is smaller than the diameter of the heating roller gear.

According to another aspect of the present invention, pressure applied by the second pressing roller to the heating roller is smaller than pressure applied by the first pressing roller to the heating roller.

According to another aspect of the present invention, material of the second pressing roller has a smaller friction coefficient than material of the heating roller so that a friction force generated between the second pressing roller and the printable medium is smaller than a friction force generated between the heating roller and the printable medium.

According to another aspect of the present invention, the fusing unit further includes a guiding member provided between the first pressing roller and the second pressing roller to guide the printable medium, having passed between the first pressing roller and the heating roller, to a gap between the second pressing roller and the heating roller.

According to another aspect of the present invention, the second pressing roller comprises a plurality of second pressing rollers.

According to another aspect of the invention, an image forming apparatus is provided. The image forming apparatus includes a feeding unit to supply a printable medium; an image forming unit to form an image onto the printable medium; a fusing unit to fuse the image formed by the image forming unit onto the printable medium; and a discharging unit to discharge the printable medium on which the image is formed.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, in which.

DETAILED DESCRIPTION OF THE EMBODIMENTS

Figure 1:
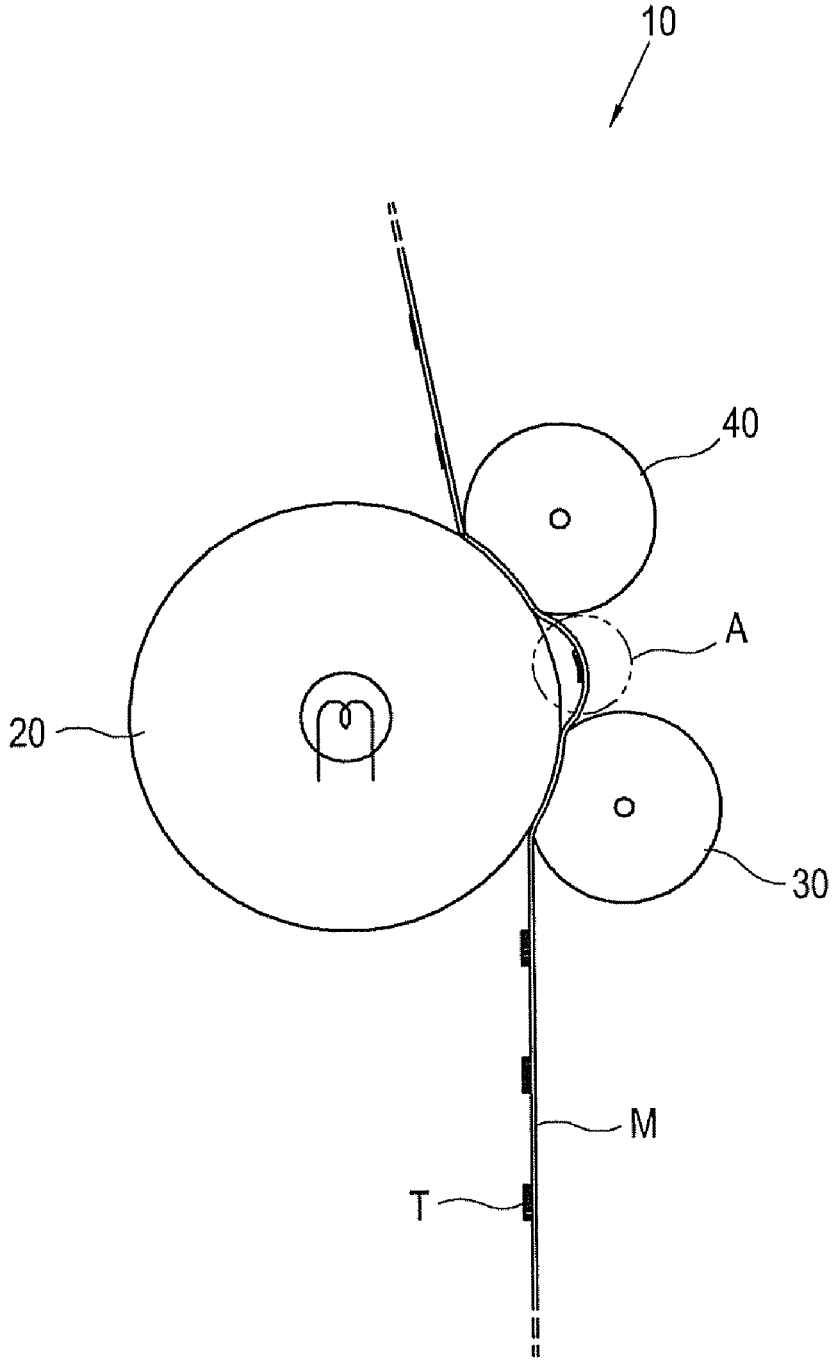
FIG. 1 (RELATED ART)
FIG. 1 is a schematic view illustrating a configuration of a conventional fusing unit.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
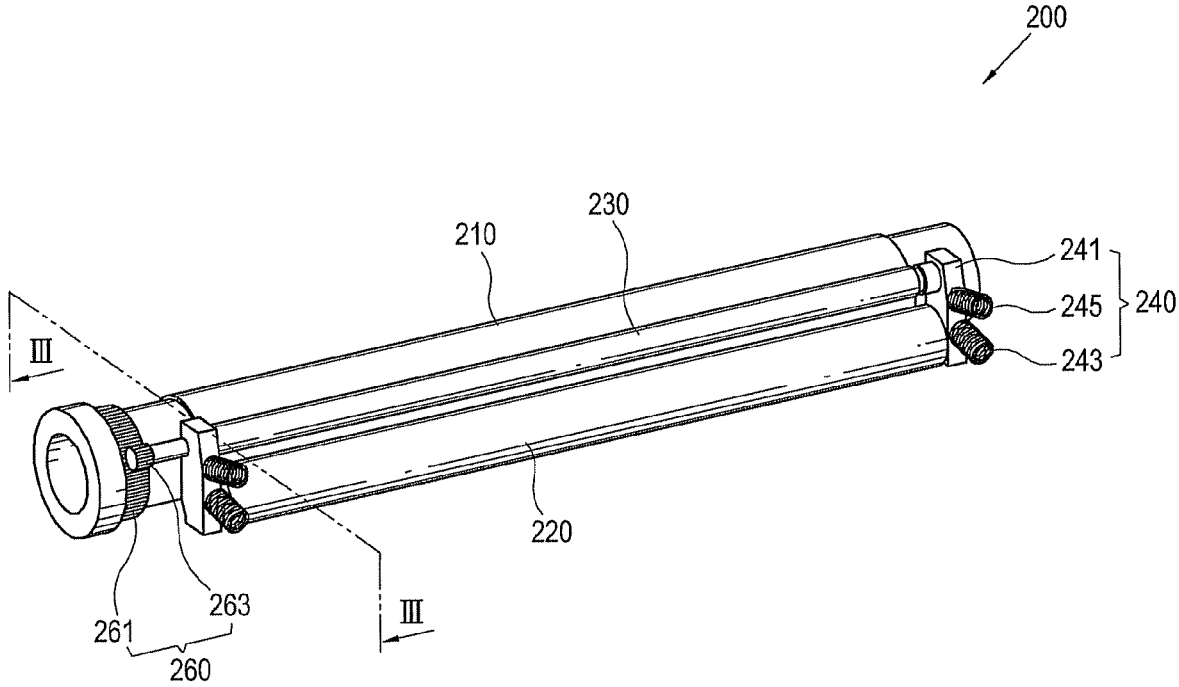
FIG. 2 is a perspective view illustrating a configuration of a fusing unit according to an embodiment of the present invention.
Figure 3:
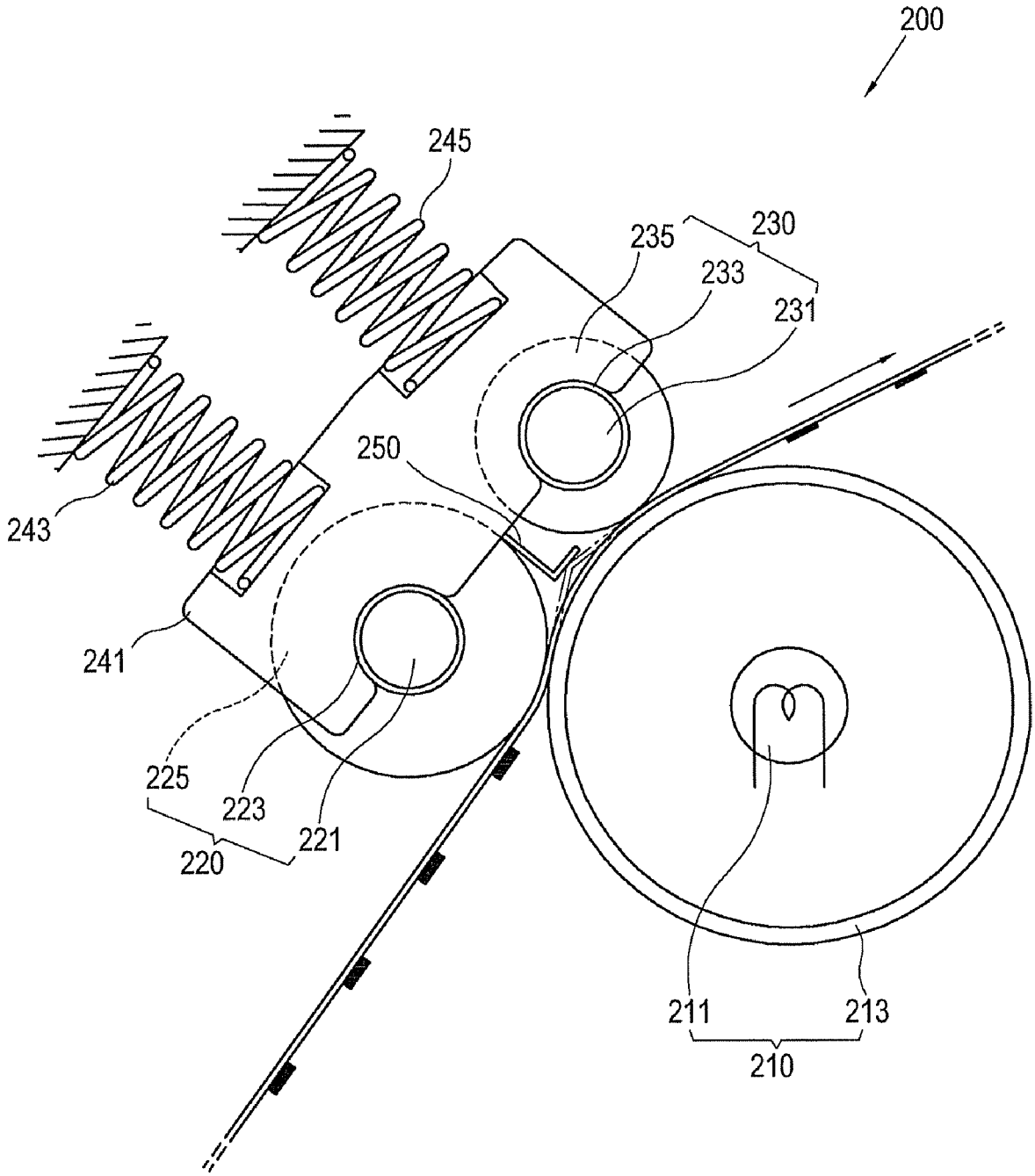
FIG. 3 is a sectional view taken along line III-III in FIG. 2.

As shown in FIGS. 2 and 3, a fusing unit 200 according to an embodiment of the present invention includes a heating roller 210, a first pressing roller 220, a second heating roller 230, an elastic supporting member 240, and a gearing unit 260. According to other aspects of the invention, the fusing unit 200 may include additional and/or different units. Similarly, the functionality of two or more of the above units may be integrated into a single component.

The heating roller 210 is heated by a heat source 211 (shown in FIG. 3) disposed therein. The first pressing roller 220 and the second pressing roller 230 are arranged so as to face the heating roller 210. The elastic supporting member 240 elastically presses the first pressing roller 220 and the second pressing roller 230 against the heating roller 210. The gearing unit 260 transmits the rotation force of the heating roller 210 so that the second pressing roller 230 rotates more rapidly than the heating roller 210. Although not required in all aspects, the fusing unit 200 may further include a guiding member 250 disposed between the first pressing roller 220 and the second pressing roller 230 to guide transportation of a printable medium M, as shown in FIG. 3.

As shown in FIG. 3, the heating roller 210 includes the heat source 211 and a heating roller main body 213 applying the heat radiated from the heat source 211 to the printable medium M. The heat source 211 radiates radiant heat for heating the heating roller main body 213. The heat source 211 may include a lamp, a heat generating resistor, or other heat generating unit provided in an inner space of the heating roller main body 213. The heating roller main body 213 is heated by the radiant heat radiated from the heat source 211, and transmits the heat to the printable medium M. The heating roller main body 213 is typically formed of a metal material having high heat conductivity, but may be formed of other materials.

The first pressing roller 220 faces the heating roller 210 to press the printable medium M against the heating roller 210. The first pressing roller 220 is disposed to contact the heating roller 210 to rotate by a friction force generated when the heating roller 210 rotates. The first pressing roller 220 rotates depending on the rotation of the heating roller 210. Accordingly, the surface linear speed of the first pressing roller 220 is the same as the surface linear speed of the heating roller 210.

Figure 4:
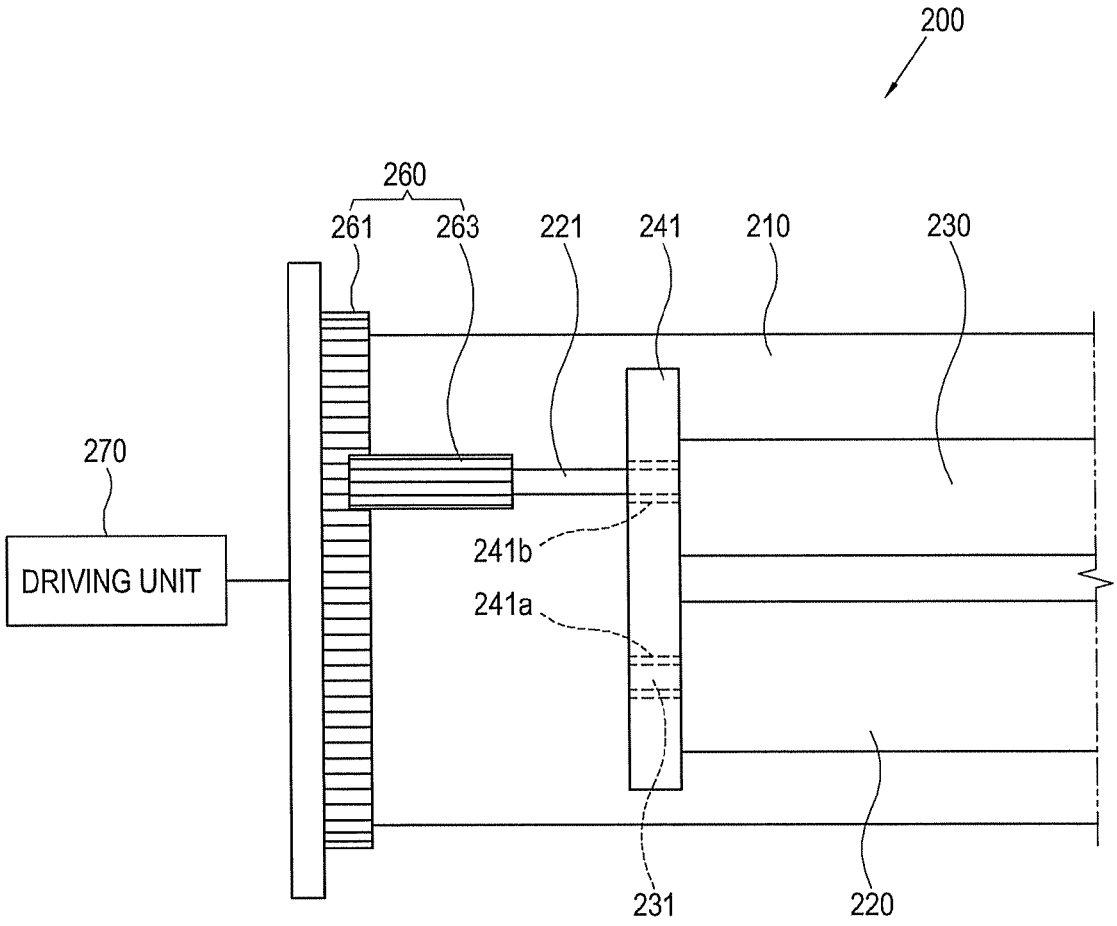
FIG. 4 is a schematic view illustrating a configuration of a gearing unit of the fusing unit illustrated in FIG. 2.

The second pressing roller 230 is disposed in front of the first pressing roller 220 in a proceeding direction of the printable medium M. The second pressing roller 230 presses the printable medium M against the heating roller 210 together with the first pressing roller 220 so as to enlarge a nip area in which the printable medium M is heated and pressed. The second pressing roller 230 receives the driving force of a driving unit 270 (shown in FIG. 4) through the gearing unit 260 to rotate more rapidly than the heating roller 210. The driving unit 270 may include a motor directly connected to the second pressing roller 230, or may be geared with a motor driving other rotating rollers. The second pressing roller 230 receives the rotation force of the heating roller 210 by means of the gearing unit 260 to rotate with a surface linear speed greater than that of the heating roller 210.

The first pressing roller 220 and the second pressing roller 230 include pressing roller rotation shafts 221 and 231, pressing roller main bodies 223 and 233, and elastic layers 225 and 235. The pressing roller main bodies 223 and 233 have cylindrical shapes to rotate centering on the pressing roller rotation shafts 221 and 231. The elastic layers 225 and 235 surround the pressing roller main bodies 223 and 233. The elastic layers 225 and 235 are formed of an elastic material, such as rubber, and are pressed by the heating roller 210 formed of a metal material so that an external appearance can be elastically deformed.

A fusing nip having a predetermined thickness is formed between the heating roller 210 and the elastic layers 225 and 235. The printable medium M receives heat and pressure when passing through the fusing nip. A developer image T not yet fused is formed on the printable medium M, and the developer image T is heated and pressed to be fused on the printable medium M when passing through the fusing nip.

The elastic supporting member 240 is provided at opposite ends of the first pressing roller 220 and the second pressing roller 230 to rotatably elastically support the first pressing roller 220 and the second pressing roller 230 against the heating roller 210. The elastic supporting member 240 includes a frame 241 supporting the rotation shafts 221 and 231 of the first pressing roller 220 and the second pressing roller 230, a first elastic member 243 elastically pressing the first pressing roller 220 toward the heating roller 210, and a second elastic member 245 elastically pressing the second pressing roller 230 against the heating roller 210.

The frame 241 includes rotation shaft accommodating units 241*a* and 241*b* respectively accommodating the rotation shafts 221 and 231 of the first pressing roller 220 and the second pressing roller 230. The first rotation shaft accommodating unit 241*a* supports the first pressing rotation shaft 221 so that the first pressing roller rotation shaft 221 can be driven by the rotation of the heating roller 210 to rotate idly. The second rotation shaft accommodating unit 241*b* accommodates and supports the second pressing roller rotation shaft 231 so that the second pressing roller rotation shaft 231 can be connected with the gearing unit 260.

The elastic force of the first elastic member 243 applied to the first pressing roller 220 may be greater than the elastic force of the second elastic member 245 applied to the second pressing roller 230. The respective elastic members 243 and 245 may be provided so that the first pressing roller 220 applies greater pressure to the heating roller 210 than the second pressing roller 230. Since the second pressing roller 230 rotates with a greater surface linear speed than the first pressing roller 220, the printable medium M will pass through the fusing unit 200 continuously due to a speed difference between the second pressing roller 230 and the heating roller 210 if the second pressing roller 230 and the first pressing roller 220 press the heating roller 210 with the same pressure.

The first elastic member 243 may have a greater modulus of elasticity than the second elastic member 245. The thicknesses and the sizes of the first elastic member 243 and the second elastic member 245 may be adjusted when the first elastic member 243 and the second elastic member 245 have the same modulus of elasticity.

As shown in FIG. 3, the guiding member 250 is provided between the first pressing roller 220 and the second pressing roller 230 to guide the printable medium M. In general, since the printable medium M has a predetermined thickness, in proceeding on a curved path, the printable medium M is apt to proceed in a tangential direction to the curved path. The printable medium M passing through between the first pressing roller 220 and the heating roller 210 is apt to proceed in a tangential direction, as illustrated by a dotted line of the heating roller 210. The guiding member 250 guides a front end of the printable medium M proceeding in the tangential direction toward the second pressing roller 230 so that the printable medium M can proceed between the second pressing roller 230 and the heating roller 210.

The guiding member 250 has such a length and a shape as to guide the printable medium M toward the second pressing roller 230. Accordingly, the length of the guiding member 250 increases as an interval between the first pressing roller 220 and the second pressing roller 230 increases. The guiding member 250 may have a curved surface having a curvature corresponding to the heating roller 210. The guiding member 250 may be coupled to the frame 241 of the elastic supporting member 240, or to an inner surface of a casing 110 of an image forming apparatus 100 to be described later.

The gearing unit 260 transmits a driving force generated from the driving unit 270 (shown in FIG. 4), such as a motor, to the heating roller 210, and transmits the rotation force of the heating roller 210 to the second pressing roller 230 so that the second pressing roller 230 can rotate more rapidly than the heating roller 210. The gearing unit 260 may employ a belt, a gear, a chain, or other gearing element.

The gearing unit 260 includes a heating roller gear 261 and a pressing roller gear 263. The heating roller gear 261 transmits the driving force from the driving unit 270 to the heating roller 210, and is disposed on at least one end of the heating roller 210 to receive the driving force of the driving unit 270. The pressing roller gear 263 extends from the rotation shaft 231 of the second pressing roller 230 to be engaged with the heating roller gear 261 to transmit the rotation force of the heating roller 210 to the second pressing roller 230.

The heating roller gear 261 and the pressing roller gear 263 are designed to have a gear ratio so that the rotation speed of the second pressing roller 230 is greater than the rotation speed of the heating roller 210. The diameter of the second pressing roller gear 263 is smaller than the diameter of the heating roller gear 261.

A rotation speed difference between the second pressing roller 230 and the heating roller 210 due to the gear ratio enables the printable medium M to approach the second pressing roller 230 without separating from the heating roller 210. If the front end of the printable medium M, upon leaving the first pressing roller 220 and the heating roller 210, enters a gap between the second pressing roller 230 and the heating roller 210, since the second pressing roller 230 rotates more rapidly than the first pressing roller 220, an area of the printable medium M separated from the heating roller 210 is pulled toward the second pressing roller 230 to enter the gap between the second pressing roller 230 and the heating roller 210.

As the interval between the first pressing roller 220 and the second pressing roller 230 increases, the speed differential between the first pressing roller 220 and the second pressing roller 230 may increase by increasing a diameter difference between the second pressing roller gear 263 and the heating roller gear 261. The speed of the second pressing roller 230 may be greater than that of the heating roller 210 by approximately 0.2~5%.

If the speed difference is smaller than 0.2%, the effect of pulling the area of the printable medium M separated from the heating roller 210 toward the second pressing roller 230 is insufficient. If the speed difference is greater than 5%, the pulling of the front end of the printable medium M may be too strong so that the fusing of a toner image T may be performed inappropriately between the first pressing roller 220 and the heating roller 210. If the gearing unit 260 transmits the rotation force so that the second pressing roller 230 rotates slower than the first pressing roller 220, the developer image T not yet fused may be separated from the surface of the printable medium M as in the conventional fusing unit.

Figure 5:
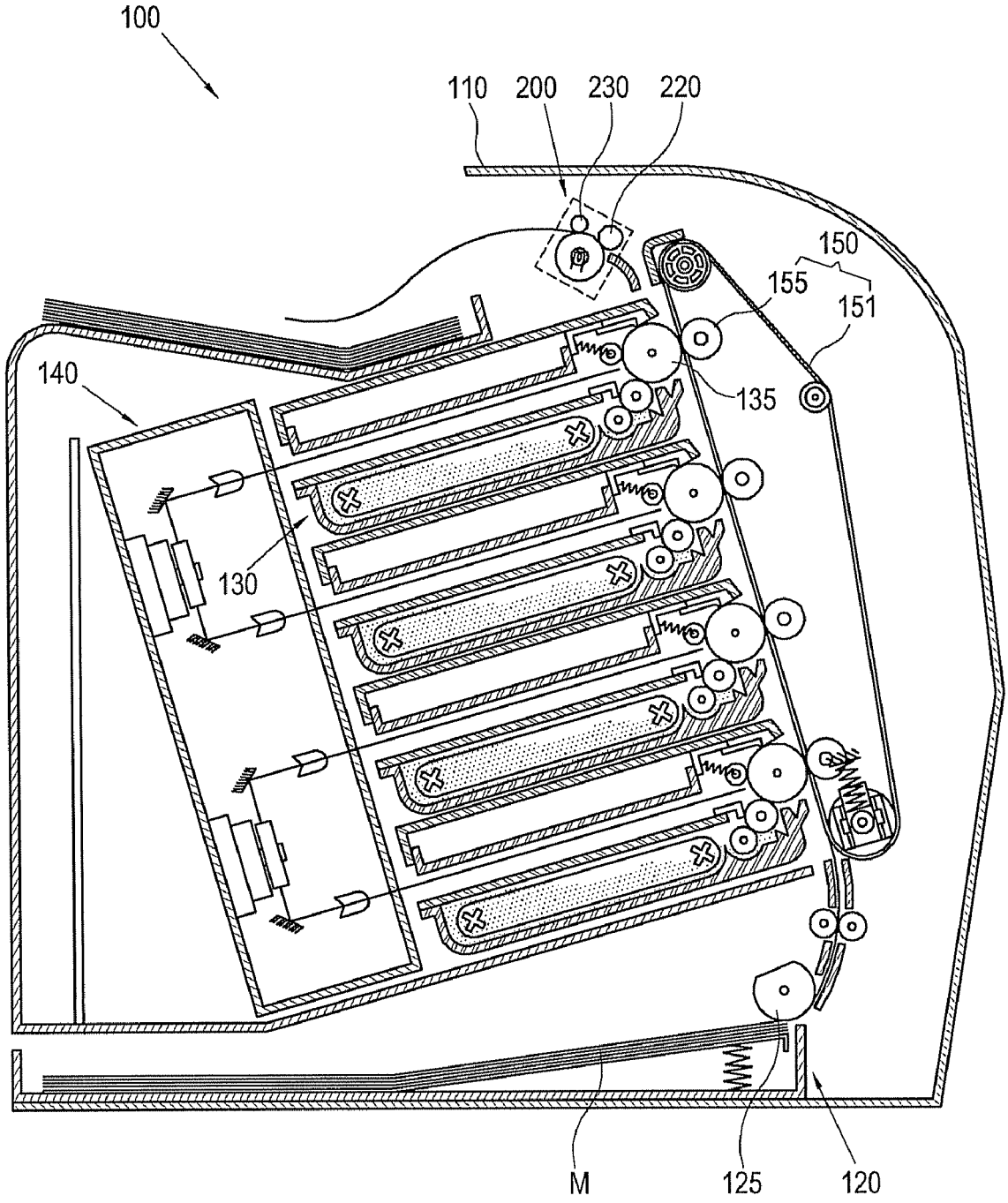
FIG. 5 is a schematic view illustrating a configuration of an image forming apparatus according to an embodiment of the present invention.

FIG. 5 is a sectional view schematically illustrating a configuration of the image forming apparatus 100 according to an embodiment of the present invention. The image forming apparatus 100 is provided as a tandem type color image forming apparatus. However, the image forming apparatus 100 according to other aspects of the present invention may be applied to a monochrome image forming apparatus, or other types of color image forming apparatuses. As shown in FIG. 5, the image forming apparatus 100 includes the casing 110, a developing unit 130, a light scanning unit 140, a transferring unit 150 and the fusing unit 200.

The casing 110 forms an external appearance of the image forming apparatus 100. A feeding unit 120, in which the printable medium M is loaded, is detachably mounted therein. The printable medium M loaded in the feeding unit 120 is picked up through a pickup roller 125 and is transported to the developing unit 130 and the transferring unit 150 along a transportation path.

The developing unit 130 includes a photosensitive body 135 responding to a light scanned from the light scanning unit 140 to form an electrostatic latent image, and develops a developer accommodated therein on the photosensitive body 135 to form the developer image T on a surface of the photosensitive body 135. The developing unit 130 may be provided plurally, one for each color, to form a full color by a single path method. FIG. 5 shows a configuration of four developing units respectively accomplishing yellow Y, magenta M, cyan C, and black K.

The light scanning unit 140 scans the light to form the electrostatic latent image of each color on the plurality of photosensitive bodies 135. The light scanning unit 140 concurrently scans the light on the plurality of photosensitive bodies 135. The light scanning unit 140 includes a light source, a beam deflecting unit deflecting the light emitted from the light source, and an imaging lens imaging the light deflected by the beam deflecting unit on a scan surface. The light scanning unit 140 may be provided in any configuration.

The transferring unit 150 faces the photosensitive body 135 to interpose the printable medium M transported along the transportation path therebetween, and transfers the developer image T formed on the photosensitive body 135 to the printable medium M. The transferring unit 150 includes a transferring belt 151 facing the plurality of the photosensitive bodies 135, and a transferring backup roller 155.

The fusing unit 200 includes the heating roller 210, the first pressing roller 220, and the second pressing roller 230, as described above. The fusing unit 200 fuses the developer image transferred but not yet fused on the printable medium M by heating and pressing between the heating roller 210 and the first and second pressing rollers 220 and 230.

An operating process of the image forming apparatus 100 will be described by referring to FIGS. 2 to 5. The printable medium M is first supplied from the feeding unit 120. The developing unit 130 applies the developer of each color to the photosensitive body 135 to form the developer image T on the photosensitive body 135. The transferring unit 150 transfers the developer image T on the surface of the photosensitive body 135 to the printable medium M.

The printable medium M enters the nip between the first pressing roller 220 and the heating roller 210 to be heated and pressed. Since the first pressing roller 220 rotates by the friction force arising from the rotation of the heating roller 210, the first pressing roller 220 rotates at the same speed as the heating roller 210. The printable medium M passing between the first pressing roller 220 and the heating roller 210 is separated from the heating roller 210, and the separated printable medium M is guided by the guiding member 250 between the second pressing roller 230 and the heating roller 210.

If the front end of the printable medium M enters the gap between the second pressing roller 230 and the heating roller 210, since the second pressing roller 230 rotates more rapidly than the heating roller 210, the area of the printable medium M passing between the first pressing roller 220 and the heating roller 210 is pulled toward the second pressing roller 230. If the printable medium M enters the gap between the second pressing roller 230 and the heating roller 210, the printable medium M is continuously pulled by the second pressing roller 230 to slip against the heating roller 210, thereby preventing the printable medium M from being detached therefrom. Accordingly, developer separation and spots in the printed image can be prevented.

While passing through the fusing unit 200, the developer image T of the printable medium M is fused on the printable medium M to complete the image forming process. The printable medium M is then discharged to the outside of the casing 110.

According to aspects of the present invention, the fusing unit includes two pressing rollers. Alternatively, the fusing unit may include a plurality of second pressing rollers as necessary. The plurality of second pressing rollers may be provided so that the surface rotation speed thereof can gradually increase according to the distance from the first pressing roller.

As described above, aspects of the present invention provides a fusing unit and an image forming apparatus having the same including a plurality of pressing rollers having different surface linear speeds to enable a printable medium to be transported forcedly contacting a heating roller. Accordingly, a developer separation and spots in the printed image generated due to separation of the printable medium from the heating roller can be prevented.

Also, in a fusing unit and an image forming apparatus having the same according to aspects of the present invention, since a second pressing roller receives a rotation force of a heating roller to rotate, a configuration of a gearing unit can be simplified.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fusing unit for an image forming apparatus, comprising:

a heating roller to apply heat to a printable medium so as to fuse a developer image onto the printable medium;

a first pressing roller facing the heating roller so as to press the printable medium against the heating roller;

a second pressing roller disposed in front of the first pressing roller in a proceeding direction of the printable medium to press the printable medium against the heating roller; and a driving unit to transmit a rotation force to the second pressing roller so that a surface linear speed of the second pressing roller is greater than a surface linear speed of the heating roller.

2. The fusing unit according to claim 1, wherein the driving unit comprises a gearing unit to transmit a rotation force of the heating roller to the second pressing roller.

3. The fusing unit according to claim 2, wherein the gearing unit comprises:

a heating roller gear provided to a rotation shaft of the heating roller to receive a driving force of the driving unit, and a pressing roller gear provided to a rotation shaft of the second pressing roller to be engaged with the heating roller gear to receive the driving force.

4. The fusing unit according to claim 3, wherein a diameter of the pressing roller gear is smaller than a diameter of the heating roller gear.

5. The fusing unit according to claim 1, wherein pressure applied by the second pressing roller to the heating roller is smaller than pressure applied by the first pressing roller to the heating roller.

6. The fusing unit according to claim 5, wherein a material of the second pressing roller has a smaller friction coefficient than material of the heating roller so that a friction force generated between the second pressing roller and the printable medium is smaller than a friction force generated between the heating roller and the printable medium.

7. The fusing unit according to claim 1, further comprising a guiding member provided between the first pressing roller and the second pressing roller to guide the printable medium, having passed between the first pressing roller and the heating roller, to a gap between the second pressing roller and the heating roller.

8. The fusing unit for the image forming apparatus according to claim 1, wherein the second pressing roller comprises a plurality of second pressing rollers.

9. An image forming apparatus, comprising:

a feeding unit to supply a printable medium;

an image forming unit to form an image onto the printable medium;

a fusing unit to fuses the image formed by the image forming unit onto the printable medium; and a discharging unit to discharge the printable medium on which the image is formed;

wherein the fusing unit comprises a heating roller to apply heat to a printable medium so as to fuse a developer image onto the printable medium, a first pressing roller facing the heating roller so as to press the printable medium against the heating roller, a second pressing roller disposed in front of the first pressing roller in a proceeding direction of the printable medium to press the printable medium against the heating roller, and a driving unit to transmit a rotation force to the second pressing roller so that a surface linear speed of the second pressing roller is greater than a surface linear speed of the heating roller.

10. The image forming apparatus according to claim 9, wherein the driving unit of the fusing unit comprises a gearing unit to transmit the rotation force of the heating roller to the second pressing roller.

11. The image forming apparatus according to claim 10, wherein the gearing unit comprises:

a heating roller gear provided to a rotation shaft of the heating roller to receive a driving force of the driving unit, and a pressing roller gear provided to a rotation shaft of the second pressing roller to be engaged with the heating roller gear to receive the driving force.

12. An image forming apparatus comprising:

an image forming unit to form an image onto a printable medium;

a feeding unit to supply the printable medium to the image forming unit;

a fusing unit to fuse the image formed by the image forming unit onto the printable medium; and a discharging unit to discharge the printable medium from the image forming apparatus;

wherein the fusing unit comprises a heating unit to apply heat to the printable medium so as to fuse the image onto the printable medium, a first pressing roller facing the heating roller so as to press the printable medium against the heating roller, a second pressing roller arranged so that the printable medium passes between the second pressing roller and the heating roller after passing between the first pressing roller and the heating roller, and a driving unit to rotate the second pressing roller so that a surface linear speed of the second pressing roller is greater than a surface linear speed of the heating roller.

13. The image forming apparatus of claim 12, wherein the driving unit comprises a gearing unit to transmit a rotation force of the heating roller to the second pressing roller.

14. The image forming apparatus according to claim 13, wherein the gearing unit comprises:

a heating roller gear coupled to a rotation shaft of the heating roller to receive a driving force from the driving unit; and a pressing roller gear coupled to a rotation shaft of the second pressing roller so as to be engaged with the heating roller to receive the driving force.

15. The image forming apparatus according to claim 14, wherein a diameter of the pressing roller gear is less than a diameter of the heating roller gear.

16. The image forming apparatus according to claim 12, wherein pressure applied by the second pressing roller to the heating roller is lower than pressure applied by the first pressing roller to the heating roller.

17. The image forming apparatus according to claim 12, wherein the surface linear speed of the second pressing roller is between 0.2% to 5% greater than the surface linear speed of the heating roller.

18. The image forming apparatus according to claim 12, wherein the fusing unit further comprises an elastic unit arranged so as to press the first pressing roller and the second pressing roller against the heating roller.

19. The image forming apparatus according to claim 18, wherein the elastic unit comprises:

a frame to support a rotation shaft of the first pressing roller and a rotation shaft of the second pressing roller;

a first elastic member to press the first pressing roller against the heating roller with a first elastic force; and a second elastic member to press the second pressing roller against the heating roller with a second elastic force.

20. The image forming apparatus according to claim 19, wherein the first elastic force is greater than the second elastic force.

21. The image forming apparatus according to claim 19, wherein the first elastic member has a greater modulus of elasticity than the second elastic member.

22. The image forming apparatus according to claim 19, wherein the frame comprises:

a first rotation shaft accommodating unit to accommodate the rotation shaft of the first pressing roller; and a second rotation shaft accommodating unit to accommodate the rotation shaft of the second pressing roller.

23. The image forming apparatus according to claim 12, wherein the fusing unit further comprises a guiding member to guide the printable medium to the second pressing roller after at least a portion of the printable medium has passed between the first pressing roller and the heating roller.

24. The image forming apparatus according to claim 12, wherein the second pressing roller comprises a plurality of pressing rollers.

25. The image forming apparatus according to claim 24, wherein a rotational speed of each of the plurality of rollers increases with a distance from the first pressing roller.

* * * * *